US005765384A

United States Patent [19]

Carlstedt et al.

[11] Patent Number: 5,765,384

[45] Date of Patent: Jun. 16, 1998

[54] EVAPORATOR WITH AN ELECTRIC HEATING CABLE FOR DEFROSTING

[75] Inventors: Jan Carlstedt, Stockholm; Mauri Ståhl, Hägersten, both of Sweden

[73] Assignee: Aktiebolaget Electrolux, Stockholm, Sweden

[21] Appl. No.: 802,482

[22] Filed: Feb. 20, 1997

[30] Foreign Application Priority Data

Apr. 4, 1996 [SE] Sweden ..... 9601314

[51] Int. Cl.[6] ..... F25D 21/06

[52] U.S. Cl. ..... 62/276

[58] Field of Search ..... 62/272, 276, 275

[56] References Cited

U.S. PATENT DOCUMENTS

| | | | |
|---|---|---|---|
| 2,685,634 | 8/1954 | Bartlowe | 62/276 |
| 2,687,626 | 8/1954 | Bartlowe . | |
| 2,705,874 | 4/1955 | Binder et al. | 62/276 |
| 2,877,630 | 3/1959 | Schultz | 62/276 |
| 3,343,596 | 9/1967 | Kritzer | 62/276 |

FOREIGN PATENT DOCUMENTS

| | | |
|---|---|---|
| 1343691 | 10/1963 | France . |

*Primary Examiner*—William Doerrler
*Attorney, Agent, or Firm*—Pearne, Gordon, McCoy and Granger LLP

[57] ABSTRACT

An evaporator (10) having an electric heating cable (20) for defrosting the evaporator comprises a tubular element (12), through which a refrigerant flows. The element (12) is constituted by an inner pipe (16) and an outer pipe (22) arranged on the outside of the inner pipe. The heating cable (20) is arranged between the pipes (16, 22) in a groove (18) arranged on the outside of the inner pipe (16).

11 Claims, 1 Drawing Sheet

EVAPORATOR WITH AN ELECTRIC HEATING CABLE FOR DEFROSTING

BACKGROUND OF THE INVENTION

The invention refers to an evaporator with an electric heating cable for defrosting the evaporator. The evaporator comprises a tubular element, through which a refrigerant flows, with the heating cable extending along the wall of the element and surface enlarging means being arranged on the element.

Such an evaporator is known through FR patent No. 1 343 691. According to this known evaporator the tubular element is constituted by a pipe, the outside of which has a groove, in which the heating cable is arranged and embedded in a heat conductive mass.

With the known evaporator, the embedment of the heating cable must be carried out with great care so that the cable does not protrude above the groove and get damaged by surface enlarging flanges, which are attached to the pipe.

SUMMARY OF THE INVENTION

The object of the invention is, in comparison with the known evaporator, to bring about an improved protection of the heating cable and to bring about a good heat conduction between the heating cable and the tubular element without the aid of a heat conductive mass.

This object is reached by the evaporator according to the invention in that the element is constituted by an inner pipe and an outer pipe. The outer pipe encloses the inner pipe, with the heating cable being arranged between the pipes.

BRIEF DESCRIPTION OF THE SEVERAL VIEWS OF THE DRAWING

An embodiment of an evaporator according to the invention is described below in connexion with the enclosed drawing, in which.

DETAILED DESCRIPTION OF PREFERRED EMBODIMENTS

Figure 1:
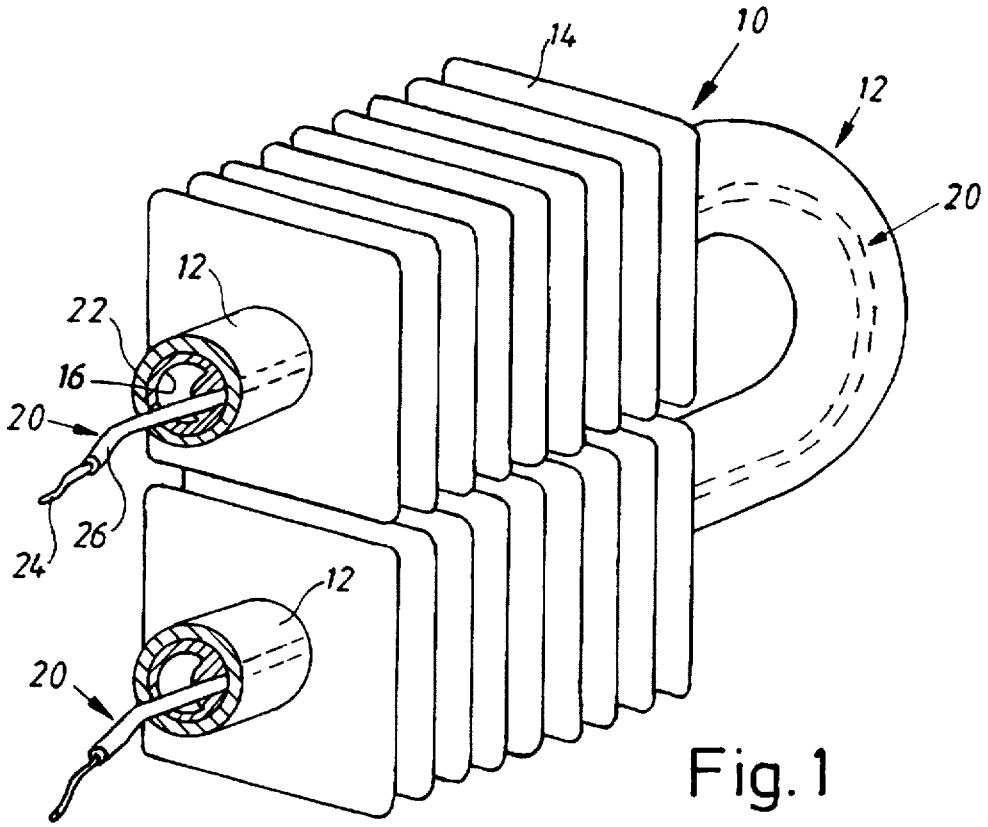
FIG. 1 shows a perspective view of a cut off part of an evaporator constituted by a tubular element provided with surface enlarging flanges, the ends of a heating cable being shown to protrude from cut off ends of the tubular element.
Figure 2:
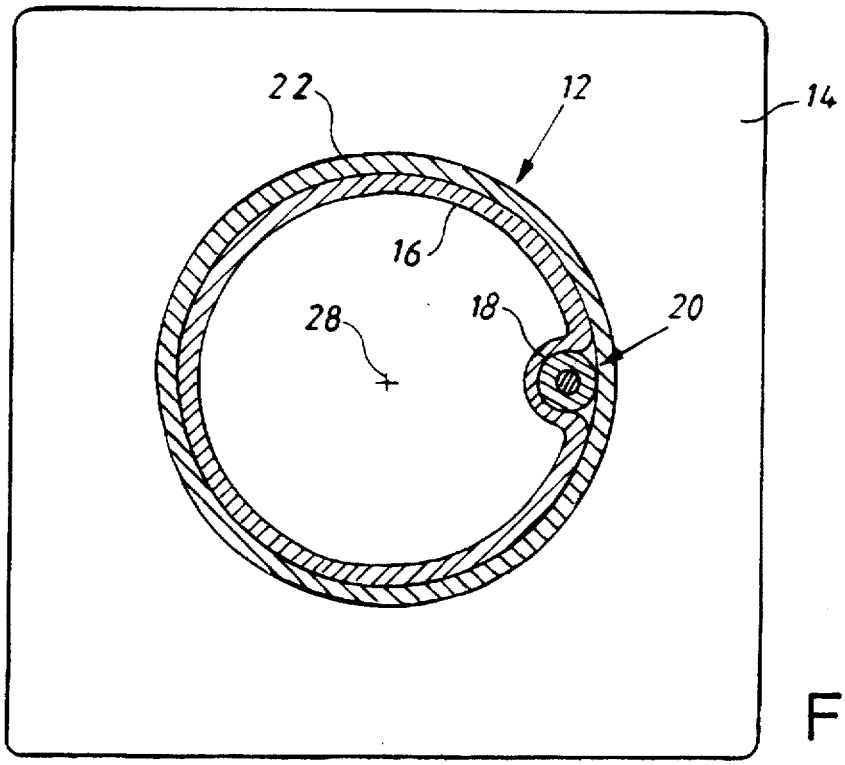
FIG. 2 shows an enlarged sectional view of the tubular element.

With reference to FIG. 1 numeral 10 designates a part of an evaporator for refrigerating air in, for instance, a dometic refrigerator. The air in turn refrigerates goods in the refrigerator. The evaporator, which can be part of a conventional compression refrigerating circuit, comprises a tubular element 12 with a cross section, which has a circular periphery. The refrigerant in the circuit is evaporated while it absorbs heat from the air surrounding the element. Surface enlarging flanges 14, of e.g. aluminium are in a conventional way arranged in good heat conductive contact with the element 12 on its outside to improve heat conduction from the air to the refrigerant.

The element 12 is constituted by an inner pipe 16, e.g. of aluminium, which on its outside has a groove 18, in which a heating cable 20 is located. Furthermore, the element 12 is constituted by an outer pipe 22, e.g. of aluminium, which is arranged on the outside of the inner pipe 16 in good heat conductive contact with it.

The heating cable 20 can be constituted by an electric resistance wire 24 surrounded by a plastic insulation 26. In order to obtain a good heat conductive contact between the heating cable 20 and the pipes 16 and 22, the insulation has been made somewhat coarser than the groove 18, so that the heating cable 20 is kept pressed against the wall of the groove by the pipe 22. When the evaporator 12 shall be defrosted electric current is conducted through the resistance wire 24, which by that will develop heat, which is conducted out to the pipes 16 and 22 via the wall of the groove 18 and via the part of the pipe 22, which opposite to the groove 18 presses against the insulation 26.

The groove 18 runs in parallel with the central axis 28 of the pipes 16 and 22.

On making the evaporator, the tubular element 12 with the heating cable 20 arranged between the pipes 16 and 22 is first produced. Then the surface enlarging flanges 14 are threaded on the element 12 and placed on suitable places on it, after which the element 12 with the heating cable 20 is bent, so that an evaporator of desired shape is obtained. It shall be pointed out that the evaporator pipe according to said FR patent No. 1 343 691 also is intended to be bent to desired shape, after its heating cable has been brought in place on the pipe.

We claim:

1. Evaporator (10) with an electric heating cable (20) for defrosting the evaporator, said evaporator comprising a tubular element (12) through which a refrigerant flows, the heating cable (20) extending along the element (12), and surface enlarging means arranged on the element, said element (12) including an inner pipe (16) and an outer pipe (22) enclosing the inner pipe, the heating cable (20) being arranged between the inner and outer pipes and including an electrical conductor surrounded by an insulating material.

2. Evaporator according to claim 1, wherein the heating cable (20) is located in a groove (18) in the inner pipe (16).

3. Evaporator according to claim 2, wherein said groove is formed by a wall of the inner pipe and the heating cable (20) is kept pressed against the wall by the outer pipe (22).

4. Evaporator according to claim 1, wherein said surface enlarging elements are arranged in heat conductive contact with an outer surface of said outer pipe.

5. Evaporator according to claim 1, wherein said inner pipe has an outer diameter larger than an outer diameter of said heating cable.

6. Evaporator according to claim 1, wherein heating cable and said inner pipe are nonconcentric.

7. Evaporator according to claim 1, wherein said inner and outer pipes comprise metal.

8. Evaporator according to claim 7, wherein said inner and outer pipes comprise aluminum.

9. Evaporator according to claim 1, wherein said outer pipe contacts at least a portion of an outer surface of said inner pipe.

10. An evaporator with an electric heating cable for defrosting the evaporator, said evaporator comprising a tubular element through which refrigerant flows, said tubular element including concentric inner and outer pipes comprised of metal, the heating cable extending along said tubular element and arranged between said inner and outer pipes, said outer pipe contacting at least a portion of an outer surface of said inner pipe, and surface enlarging means arranged on an outer surface of said outer pipe.

11. An evaporator with an electric heating cable for defrosting the evaporator, said evaporator comprising a tubular element through which refrigerant flows, the heating cable extending along said tubular element, and surface enlarging means arranged on said tubular element, said tubular element including an inner pipe and an outer pipe enclosing the inner pipe, wherein the heating cable is located between said inner and outer pipes and nonconcentric with said inner pipe.

* * * * *